US006552701B1

(12) United States Patent
Tanaka

(10) Patent No.: US 6,552,701 B1
(45) Date of Patent: Apr. 22, 2003

(54) DISPLAY METHOD FOR PLASMA DISPLAY DEVICE

(75) Inventor: Akira Tanaka, Tokyo (JP)

(73) Assignee: NEC Corporation, Tokyo (JP)

( * ) Notice: Subject to any disclaimer, the term of this patent is extended or adjusted under 35 U.S.C. 154(b) by 776 days.

(21) Appl. No.: 09/618,043

(22) Filed: Jul. 17, 2000

(30) Foreign Application Priority Data

Jul. 28, 1999 (JP) ..... 11-213582

(51) Int. Cl.[7] ..... G09G 5/10

(52) U.S. Cl. ..... 345/63; 345/37; 345/41; 345/60; 345/690

(58) Field of Search ..... 345/37, 41, 60, 345/63, 690

(56) References Cited

U.S. PATENT DOCUMENTS 5,187,578 A * 2/1993 Kohgami et al. ..... 345/692
6,052,112 A * 4/2000 Tanaka et al. ..... 345/596
6,097,358 A * 8/2000 Hirakawa et al. ..... 345/63

FOREIGN PATENT DOCUMENTS

JP 5-127612 5/1993
JP 5-127613 5/1993
JP 5-127614 5/1993
JP 5-127636 5/1993
JP 9-218662 8/1997
JP 10-116053 5/1998
JP 10-153980 6/1998
JP 11-119729 4/1999

OTHER PUBLICATIONS

Kohgami et al., "Gray–Scale Expression of TV Images on a Gas Discharge Memory Panel Display", IEICE Technical Report, vol. 90 No. 89, pp. 7–14, 1990.

* cited by examiner

*Primary Examiner*—Bipin Shalwala
*Assistant Examiner*—Vincent E. Kovalick
(74) *Attorney, Agent, or Firm*—McGinn & Gibb, PLLC

(57) ABSTRACT

First and second gradation bit groups are obtained by dividing m ($4 \leqq m < n$) gradation bits from the most significant bit into two halves so as to make weights thereof half where n is a total number of gradation bits. Then, a plurality of sub-fields in the first and second gradation bit groups is arranged to be equal to each other. Subsequently, at least part of sub-fields of (n−m) non-divided gradation bits among the n gradation bits are arranged in between the first and second gradation bit groups. A time interval between the first and second gradation bit groups is thereby determined to be h/2±h/14 (msec), where h (msec) is time of one field of a video signal to be displayed.

10 Claims, 6 Drawing Sheets

DISPLAY METHOD FOR PLASMA DISPLAY DEVICE

BACKGROUND OF THE INVENTION

1. Field of the Invention

The present invention relates to a display method for a plasma display device for displaying gradation by a sub-field technique. More particularly, it relates to a display method for a plasma display device reducing a dynamic-image pseudo contour in a large-area flicker that occurs when a television signal of a relatively low vertical synchronizing frequency or the like is displayed.

2. Description of the Related Art

It is a common practice to use the sub-field technique to display gradation in a display device, which can provide only binary display in principle, such as a plasma display device that employs a memory effect for display. The sub-field technique can be applied to a display device that can provide quick response such as a plasma display device. This technique quantizes a video signal and displays the resulting one-field data by time-sharing for each gradation bit.

Specifically, one field is divided into a kind of group of fragmented fields or a plurality of so-called sub-fields, each of which is weighted by the number of times of light emissions corresponding to each gradation bit. Then, the sub-field technique or a time-sharing technique is used to reproduce images in sequence to accumulate the images over one field by the integral effect of vision, so that natural gradation images are expressed.

For example, to realize a 256-level gradation display, the sub-field technique quantizes (converts analog to digital) in general an input analog video signal to brightness signals of 8 bits corresponding to gradation brightness data, each brightness of which differs by two times.

Then, the quantized video signal data is accumulated in a frame buffer memory.

Let the most significant bit MSB having the highest brightness be designated by B1, a bit having the second highest brightness by B2, and other bits by B3, B4, B5, B6, B7, and B8, respectively. The brightness ratio among the bits corresponds to 128:64:32:16:8:4:2:1. These bits are selected by each pixel, so that 256 levels of gradation can be realized in total, which correspond to brightness levels from 0 to 255.

FIG. 1 is a schematic diagram showing a prior-art display method for an AC color plasma display device. The method shown in FIG. 1 employs a sub-field technique in accordance with scan/sustain separate driving. As shown in FIG. 1, one field is divided into 8 sub-fields, or sub-fields SF1 to SF8, each of which has a scan period and a sustaining discharge period. During the scan period of the sub-field SF1, display data of the most significant bit B1 is written to each pixel. Then, after the data has been written, a sustaining discharge pulse is applied to the entire panel to allow only those pixels to which the data has been written to emit light for display. Subsequently, the sub-fields SF2 and other sub-fields are also driven in the same way. To provide sufficient brightness, for example, the pulse is applied to the sub-field SF1 256 times, to the sub-field SF2 128 times, and to sub-fields SF3 to SF8 64 times, 32 times, 16 times, 8 times, 4 times, and 2 times during the sustaining discharge period of each of the sub-fields. The numerals in FIG. 1 designate a weight assigned to each of the sub-field.

The aforementioned arrangement, in which one field is constituted so that the relative ratio of brightness decreases with time, is called a descending-order sub-field arrangement. In contrast, an arrangement in which one field is constituted so that the relative ratio of brightness increases with time is called an ascending-or der sub-field arrangement. These arrangements practiced in the sub-field technique are not special ones but have been conventionally used in general.

Other than these two arrangements, there are also other various techniques available only if the techniques are intended to display gradation. However, in cases where arrangements were simply replaced with one another in these sub-field arrangements, any one of the arrangements would cause the following disadvantages.

In general, the update speed of a screen is so set as to be the same as that of the vertical synchronizing signal in both a CRT display and a plasma display device. Accordingly, the optical stimulus to which human eyes are actually subjected on the screen is recognized as blinking in brightness proportional to the vertical synchronizing signal. As the repeated cycle of the blinking in brightness becomes longer, the blinking is recognized as more distinct flashing. On the other hand, as the repeated cycle becomes shorter, the blinking is recognized as continuous lighting. The boundary cycle between the continuous lighting and the flashing is called the "CFF (Critical Fusion Frequency or Critical Flicker Frequency)". The CFF is described in a paper, "Gradation Display Scheme for Television using a memory gas-discharge panel", by Kohgami and Mikoshiba, which is described on pages 11 to 13 of Shingaku Engineering report EID 90-9.

The vertical synchronizing frequency employed by the European TV standards is 50 Hz in general. Thus, the repeating cycle of the vertical synchronizing signal and that of the video signal are generally the same as the CFF or 20 msec. Recognition of blinking in brightness as flashing or continuous lighting depends on the brightness level of a video signal to be displayed. One would recognize a similar video signal displayed more frequently as flashing if the signal had a higher brightness level. A state that is recognized as flashing is generally called a flicker. A flicker, recognized on the whole screen and caused by a low vertical synchronizing frequency, is called a large-area flicker. The large-area flicker frequently causes a problem of interfering with viewing of the screen on which signals are displayed particularly with high brightness levels.

As countermeasures against such a large-area flicker, a technique called the "100 Hz TV" for increasing the vertical frequency two times at the reception side of images has been used lately in the television with a CRT. This technique can be realized by accumulating image data for one picture in a memory and reading out the data twice at double speed. This technique can reduce the large-area flicker to such an extent that the flicker is hardly detected.

It is known in the plasma display device that some of the higher order sub-fields can be divided into halves and the arrangement of the two divided sub-field groups can be set as appropriate, thereby reducing the large-area flicker. For example, the aforementioned technique was suggested as processing for increasing the field frequency two times or more to reduce jerkiness in Japanese Patent Laid-Open Publication No. Hei 5-127612. Techniques similar to this were suggested in Japanese Patent Laid-Open Publications No. Hei 5-127613, No. Hei 5-127614, and No. Hei 5-127636. Among the publications, the techniques described in Japanese Patent Laid-Open Publications No. Hei 5-127614 and No. Hei 5-127636 aim to reduce flicker.

The higher the brightness is, the more noticeable the large-area flicker becomes. Thus, it is not always necessary to divide all gradation bits into halves in a plasma display device. That is, it is not sufficiently effective to divide lower order bits into halves that contribute to gradation display with low brightness when the large-area flicker is to be reduced. Thus, it is conceivable to divide relatively higher order bits into halves to reduce the large-area flicker. It is described in the aforementioned publications to divide higher order bits into halves in order to reduce the jerkiness of dynamic images. As such, these publications do not aim to reduce flicker. Accordingly, no publications are available so far that disclose the number of bits, settings of time, and arrangements to be divided into. Therefore, it cannot be said that the techniques set forth in the publications sufficiently and effectively prevent the large-screen flicker even when the techniques are carried out as they are described.

Recently, a technical theme of reducing dynamic-image pseudo contours has become a focus of most attention in the plasma display device. Dividing higher order bits into two halves can considerably reduce the dynamic-image pseudo contours. However, this cannot be said to be enough. In addition, the relatively lower order gradation bits that are not divided still have a phenomenon of dynamic-image pseudo contours in a dark image. For this reason, the technique of. distributing and arranging lower order bits in terms of time to take measures against the large-area flicker as shown in the aforementioned publications exerts an adverse effect on the level of occurrence of dynamic-image pseudo contours caused by the lower order bits. This can be explained readily from the fact that gradation transition between lower-order sub-fields accompanies a significant displacement in the center of gravity of light emission.

Displaying on a plasma display device such a video signal with a relatively low vertical synchronizing frequency as is employed in the European TV standards would cause the large-area flicker like one on the CRT display device. In general, the sub-field technique is used to realize gradation display on a plasma display device. Higher order sub-fields can be further divided into two halves and appropriate time intervals can be provided, thereby enabling measures against the large-area flicker relatively easily. In addition, most plasma display devices are used as a computer display unit with the vertical synchronizing frequency being set to a frequency higher than that employed by the European TV standards. However, viewing for many hours video signals not only with a sufficiently high vertical synchronizing frequency but also with a relatively low vertical synchronizing frequency would undesirably tire human eyes. Using a plasma display device for which the sub-field technique is employed to take measures against flicker allows the vertical synchronizing signal frequency to be increased two times, thereby providing a great advantage for VDT operators.

Consider a prior-art technique, for example, the technique described in Japanese Patent Laid-Open Publication No. Hei 5-127614 for reducing the large-area flicker. The technique only divides the two highest order bits into two halves for setting. However, this cannot provide a sufficient effect of reducing flicker for various types of image patterns. This is because combination of sub-fields employed by image patterns will cause time setting of the sub-fields that are not divided to vary. In addition, reduction of dynamic-image pseudo contours is not included in the processing of lower order bits, so that flicker can be prevented but a pseudo contour in a dark portion may readily occur. Furthermore, the large-area flicker is not sufficiently and effectively reduced.

SUMMARY OF THE INVENTION

The object of the present invention is to provide a display method for a plasma display device, which can reduce large-area flicker down to a level such that the flicker can be hardly noticed in practice, and which can reduce dynamic-image pseudo contours. The large-area flicker presents a problem when a video signal with such a low vertical synchronizing frequency as recommended by the European TV standards. Still another object of the present invention is desirably to reduce further the dynamic-image pseudo contours while reducing the large-area flicker by preferably employing redundant codes for video signals.

According to one aspect of the present invention a display method for a plasma display device comprises the steps of: obtaining first and second gradation bit groups by dividing m ($4 \leqq m < n$) gradation bits from the most significant bit into two halves so as to make weights thereof half, where n is a total number of gradation bits; arranging a plurality of sub-fields in said first and second gradation bit groups so as to be equal to each other; and determining a time interval between said first and second gradation bit groups to be $h/2 \pm h/14$ (msec), where h (msec) is time of one field of a video signal to be displayed, by arranging at least one sub-field of the (n−m) non-divided gradation bits among said n gradation bits in between said first and second gradation bit groups.

The step of arranging at least one field may comprise the steps of: arranging higher order sub-fields by placing higher priority thereto among said (n−m) sub-fields in between said first and second gradation bit groups; and arranging the remaining sub-fields among said (n−m) sub-fields in a time interval other than one in between said first and second gradation bit groups.

At this time, sub-fields arranged within said first and second gradation bit groups, sub-fields arranged in between said first and second gradation bit groups, and sub-fields arranged in a time interval other than one in between said first and second gradation bit groups may be arranged in ascending order in each group from a gradation bit with the least weight, or in descending order in each group from a gradation bit with the greatest weight.

In addition, particularly when a video signal with a vertical synchronizing frequency of 50Hz recommended by the European TV standards is displayed, for example, an approximately 10 msec intervals may be provided in between the first and second gradation bit groups. At this time, said (n−m) sub-fields may be desirably arranged in between the gradation bit groups as many as possible from higher order bits so as to fall within the interval of 10 msec.

Furthermore, with the aforementioned steps being employed, a redundant code with several ways of expressing a level of gradation as a gradation bit may be employed.

According to the present invention, four or more gradation bits are divided into halves from the most significant bit in sequence and arranged at intervals of approximately a half of one field. Thus, the large-area flicker can be reduced down to such a level that the flicker can be hardly noticed.

Furthermore, the non-divided sub-fields of relatively lower order gradation bits are arranged in between the first and second gradation bit groups. Consequently, dynamic-image pseudo contours caused by the lower order bits can be reduced in a dark portion on a display screen. The non-divided sub-fields also serve to adjust the interval of one-half of a field period by being inserted in between the gradation bit groups.

In addition, as many sub-fields as possible are extracted from the higher order ones from the non-divided sub-fields to be arranged in between the first and second gradation bit groups, thereby enabling improvement of dynamic-image pseudo contours in a dark portion. On the other hand, arranging so many sub-fields as to significantly exceed the condition of approximately one-half of a field period would deteriorate the level of a large-area flicker. Therefore, an allowance limit is imposed on the number of sub-fields to be set in between the first and second gradation bit groups without causing any practical problem. In the present invention, the setting of time for gradation bit groups is adapted to fall within the range of ±1/14 of a field period centered on one-half of a field time.

Within this range, the large-area flicker can be reduced down to a practical level, as the findings to be described later in the embodiments will show. Thus, according to the present invention, it is not necessary to provide an idle time for adjusting the interval between the first and second gradation bit groups, so that as many lower order non-divided sub-fields as possible can be concentrated in one place. The fact that an idle time needs not to be provided means that higher degrees of freedom are provided for allotting time of the whole drive sequence in a limited one field. The time that can be allotted freely can effectively contribute to improvement in brightness of the plasma display device and in quality of dynamic image.

As described above, the present invention allows the large-area flicker to be tremendously reduced and the dynamic-image pseudo contours to be reduced at the same time. In addition, the time for assembling the sub-field sequences can also be reduced significantly.

That is, according to the present invention, the large-area flicker can be reduced to a level at which no problem is presented in practice even at the time of display with high brightness as is recommended by the European TV standards. At the same time, obtrusive interference with the display quality by dynamic-image pseudo contours can be greatly improved which is a drawback caused by the sub-field technique. On the other hand, no additional cost is required. Thus, the present invention will make it possible to realize a full-color multi-level dynamic-image display device with good display quality such as a large-screen television and a full-color computer display device.

DETAILED DESCRIPTION OF THE PREFERRED EMBODIMENT

Figure 1:
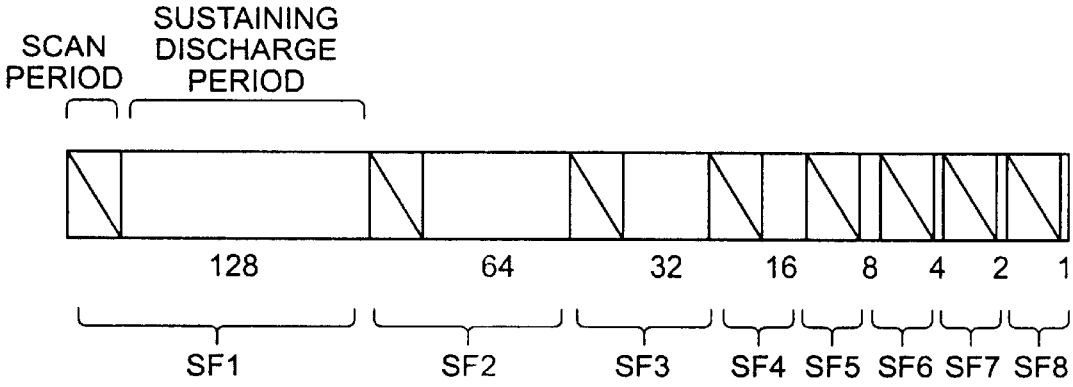
FIG. 1 (PRIOR ART)
FIG. 1 is a schematic view showing a prior-art display method for an AC color plasma display device.
Figure 2:
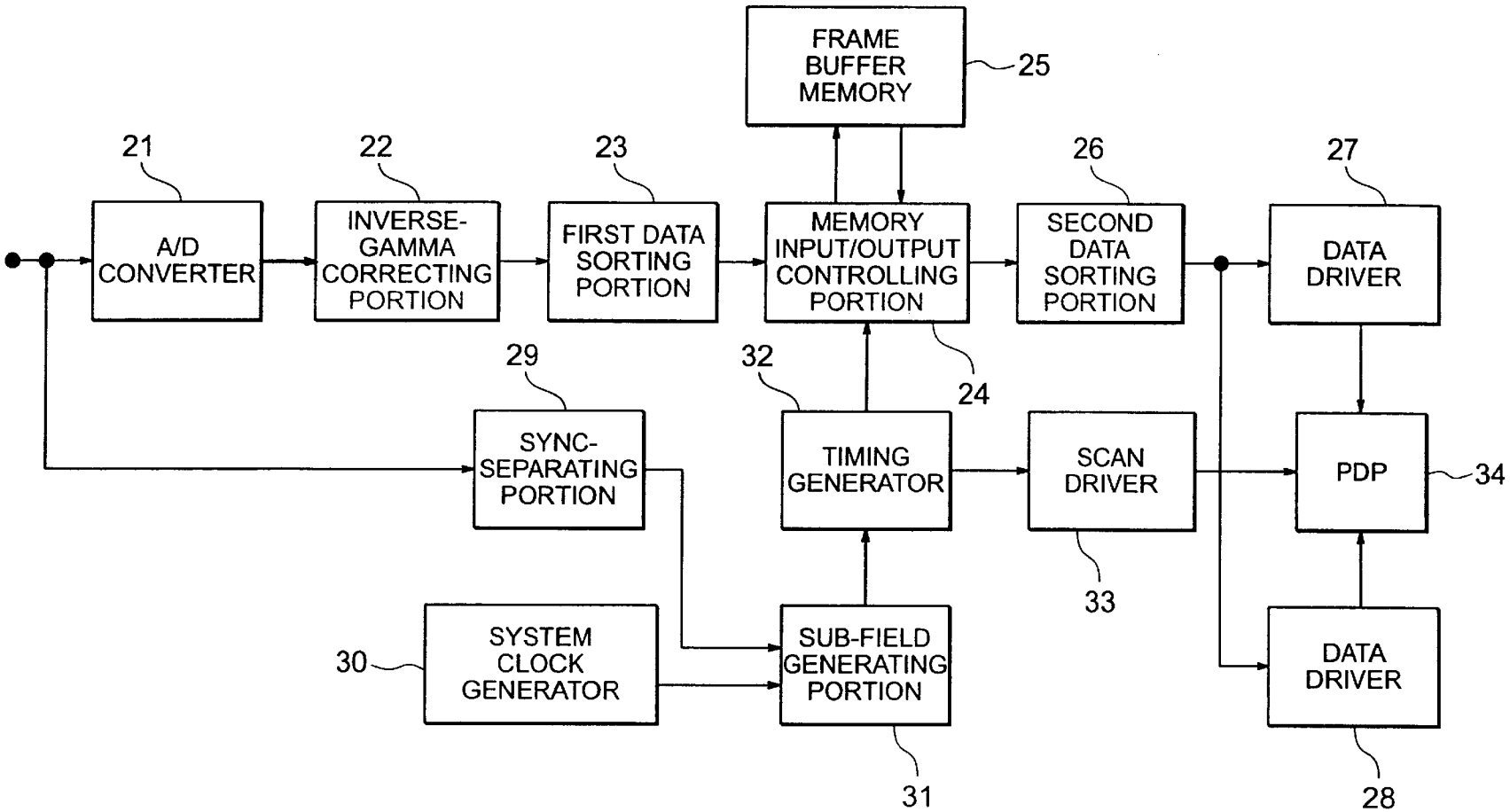
FIG. 2 is a block diagram showing the flow of a video signal in a plasma display device.

Now, a display method for a plasma display device according to embodiments of the present invention will be explained specifically with reference to the accompanying drawings. FIG. 2 is a block diagram showing the flow of a video signal in a plasma display device. The plasma display device shown in FIG. 2 employs three channels of video signals or R, G, and B. The display method according to the present invention was verified using the plasma display device shown in FIG. 2.

The plasma display device allows a video signal quantized by an A/D converter 21 provided for a video signal in each of the channels to be subjected to data correction for brightness in an inverse-gamma correcting portion 22. The video signals of three channels of R, G, and B, which have gone through the correction, are mixed in a first data sorting portion 23 to constitute such an arrangement as to be stored readily in a frame buffer memory 25. Moreover, the video signals are drawn up such that each of the gradation bits can obtain a different address. A memory I/O controlling portion 24 is an input/output (I/O) buffer for controlling reading/writing between the frame buffer memory 25 and stages before or after the memory. The data, which have been read out from each of sub-fields and represent each of the gradation bits of the video signals, are converted into a final arrangement of data via the aforementioned memory I/O controlling portion 24 by a second data sorting portion 26. Then, the data that have been converted by the second data sorting portion 26 are outputted to, for example, two channels of data drivers 27, 28.

Among the synchronizing signals separated in a sync-separating portion 29 from the video signals, the vertical synchronizing signal is outputted to a sub-field generating portion 31. The signal is used as a reference signal in the entire sub-field sequence. A system clock is supplied from a system clock generator 30 to the sub-field generating portion 31. The sub-field generating portion 31 generates the order of sub-fields, employing the aforementioned vertical synchronizing signal as the reference. A timing generator 32 receives outputs from the sub-field generating portion 31 and outputs various timing signals to the memory I/O controlling portion 24 and the like as well as to a scan driver 33. The scan driver 33 drives the scan electrodes on a PDP 34.

In the PDP 34, scan pulses are applied to the scan electrodes in sequence and data pulses are applied from the scan driver 33 to the data electrodes that have been selected in synchronization therewith. After the line sequential scan has been carried out over the entire panel, sustaining discharge is activated over the entire panel, providing colored light emission.

The display method according to the embodiment was verified as follows. That is, such operation was carried out in a plurality of sub-fields associated with gradation data quantized into a one-fiftieth second field to display a dynamic image with half-tone while a video signal based on the European TV standards is being inputted.

In the prior art, to display 246 levels of gradation on the plasma display device, sub-fields SF1 to SF8 are employed corresponding to eight gradation bits from the most significant bit (MSB) B1 to the least significant bit (LSB) B8.

Figure 3:
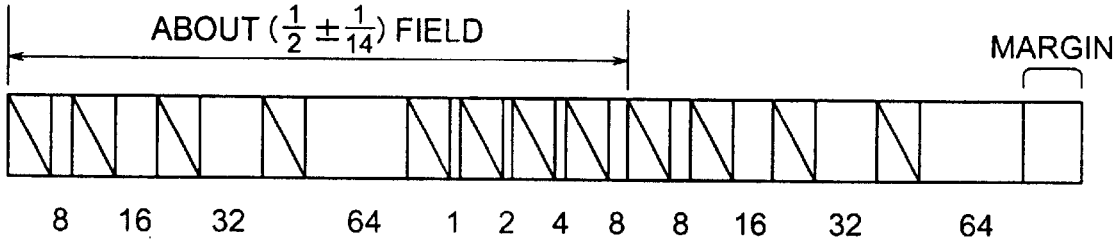
FIG. 3 is a schematic view showing an arrangement of sub-fields in a display method for a plasma display device according to a first embodiment of the present invention.

In contrast, in the first embodiment of the present invention, each of the sub-fields corresponding to the gradation bits from the most significant bit B1 to the bit B4, which is the third lower order bit from the bit B1, are divided into two sub-fields. FIG. 3 is a schematic view showing an arrangement of sub-fields in a display method for a plasma display device according to the first embodiment of the present invention.

Then, a field comprising 8 sub-fields in the case of the prior-art binary coding is reorganized into an arrangement of 12 sub-fields in the ascending order as a whole or in a repeated manner of ascending order arrangement as follows.

That is, in the first gradation bit group, let SF1=B4/2, SF2=B3/2, SF3=B2/2, and SF4=B1/2. In the lower order sub-fields that are not divided, SF5=B8, SF6=B7, SF7=B6, and SF8=B5. In the second gradation bit group, let SF9=B4/2, SF10=B3/2, SF11=B2/2, and SF12=B1/2.

The sets of the sub-fields, which have been divided into halves, such as the sub-fields SF1 to SF4 and SF9 to SF12 are the aforementioned two gradation bit groups.

In this embodiment, the time interval of the gradation bit groups is set to (½±1/14) field. In particular, in the case of the European TV standards, it is set to 10 msec±1.4 msec.

From the viewpoint of the order, such a configuration is employed as a whole in which the first gradation bit group, the lower order non-divided sub-fields, and the second gradation bit group are arranged in that order.

In addition, when the first gradation bit group is arranged in ascending order, the second gradation bit group is also arranged in ascending order. The lower order non-divided sub-fields, which are sandwiched by the two gradation bit groups, are also arranged in ascending order. Weights W(x) can be assigned to the arrangements of these sub-fields, for example, as follows. Incidentally, variable x shows the order of the sub-fields, for example, the weight of the sub-field SF1 is shown by W(1).

For example, they are set such that W(1)=8, W(2)=16, W(3)=32, W(4)=64, W(5)=1, W(6)=2, W(7)=4, W(8)=8, W(9)=8, W(10)=16, W(11)=32, and W(12)=64.

Figure 4:
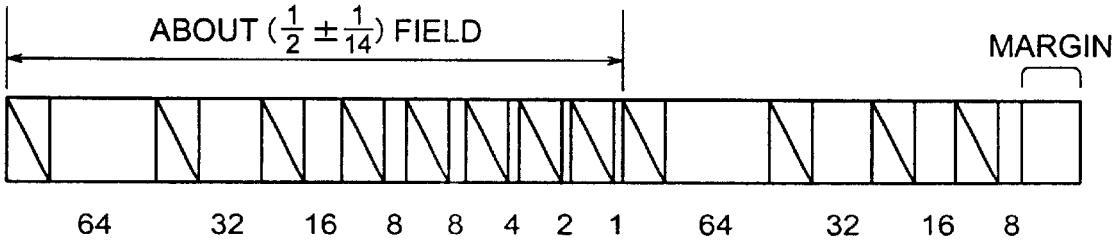
FIG. 4 is a schematic view showing an arrangement of sub-fields in a display method for a plasma display device according to a second embodiment of the present invention.

Next, a second embodiment of the present invention will be explained. FIG. 4 is a schematic view showing an arrangement of sub-fields in the display method for a plasma display device according to the second embodiment of the present invention.

In the second embodiment, the entire flow is arranged in descending order opposite to the first embodiment. In this case, the sub-fields of the first and second gradation bit groups and the lower order non-divided sub-fields are arranged in descending order.

That is, in the first gradation bit group, let SF1=B1/2, SF2=B2/2, SF3=B3/2, and SF4=B4/2. In the non-divided sub-fields, SF5=B5, SF6=B6, SF7=B7, and SF8=B8. In the second gradation bit group, let SF9=B1/2, SF10=B2/2, SF11=B3/2, and SF12=B4/2.

When the first gradation bit group is arranged in descending order, the second gradation bit group and the lower order sub-fields are arranged in descending order as well. Weights W(x) can be assigned to the arrangements of these sub-fields, for example, as follows.

That is, they are set such that W(1)=64, W(2)=32, W(3) =16, W(4)=8, W(5)=8, W(6)=4, W(7)=2, W(8)=1, W(9)=64, W(10)=32, W(11)=16, and W(12)=8.

Figure 5:
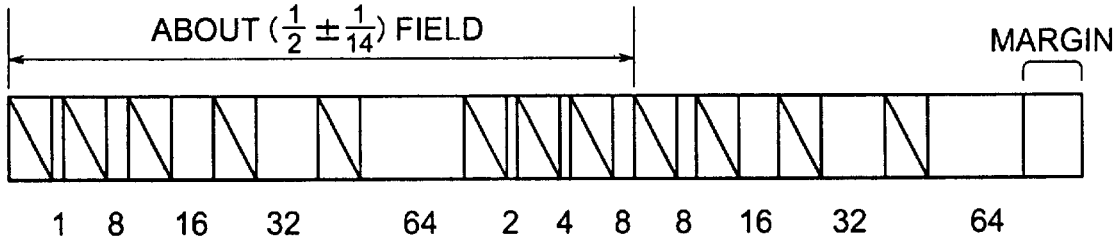
FIG. 5 is a schematic view showing an arrangement of sub-fields in a display method for a plasma display device according to a third embodiment of the present invention.

In the first and second embodiments, all the lower order non-divided sub-fields are set in between the first and the second gradation bit groups. However, in the case of setting as such, some method for assembling sub-fields can cause the time interval between the first and the second gradation bit groups to exceed a great deal the one-half of one field time. In this case, the large-area flicker may increase. Next, a third embodiment of the present invention is explained which is intended to prevent an increase in such large-screen flicker. FIG. 5 is a schematic view showing an arrangement of sub-fields in the display method for a plasma display device according to the third embodiment of the present invention.

In the third embodiment, in contrast to the first embodiment, the number of sub-fields is reduced which are set in between the first and the second gradation bit groups.

In the case of an arrangement in ascending order, a sub-field corresponding to bit B8 is set to the head of the one field so as to reduce the time interval between the two gradation bit groups. In addition, bits B7, B6, and B5 are left where they were and are sandwiched by the first and the second gradation bit groups.

According to the third embodiment configured as such, the relation among the lower order bits in terms of time is slightly deteriorated when compared with the first embodiment, however, a bit to be separated in terms of time is the least significant bit LSB. For this reason, only a slight effect is exerted on the entire image quality and thus no practical problem will be raised.

Figure 6:
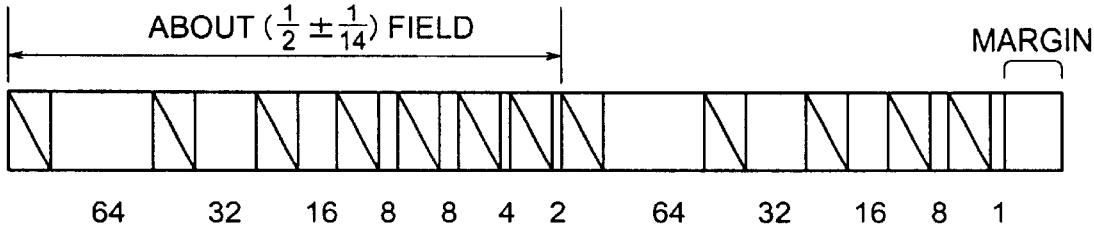
FIG. 6 is a schematic view showing an arrangement of sub-fields in a display method for a plasma display device according to a fourth embodiment of the present invention.

Next, a fourth embodiment of the present invention will be explained. FIG. 6 is a schematic view showing an arrangement of sub-fields in the display method for a plasma display device according to the fourth embodiment of the present invention.

In contrast to the second embodiment, the fourth embodiment has a reduced number of sub-fields that are set in between the first and the second gradation bit groups. That is, a sub-field corresponding to the bit B8 is set to the tail of one field.

Incidentally, consider cases where the time interval between the first and the second gradation bit groups exceeds one-half of one field a great deal by means of the third or the fourth embodiment. A sub-field corresponding to not only the bit B8 but also B7 may be set to the head or the tail of a field, thereby adjusting the time interval between the first and the second gradation bit groups. That is, only the bits B6 and B5 may be preferably left in between the two gradation bit groups.

Now, the time interval between the two gradation bit groups will be discussed to determine the maximum value of sub-fields that can be set in between the two gradation bit groups.

The time interval is most preferably set to one-half of a field time. However, in practice, some method for assembling a sub-field sequence can conceivably exceed the time a great deal. For this reason, the present inventor determined a tolerance by calculation in offset from the one-half of one field of the time interval between the gradation bit groups.

First, consideration was given to a light source such as an LED that blinks at 100 Hz. Drive pulses are applied to such a light source at 10 msec intervals. The light emitted therefrom is recognized as continuous lighting (in a direct current manner).

Figure 7A:
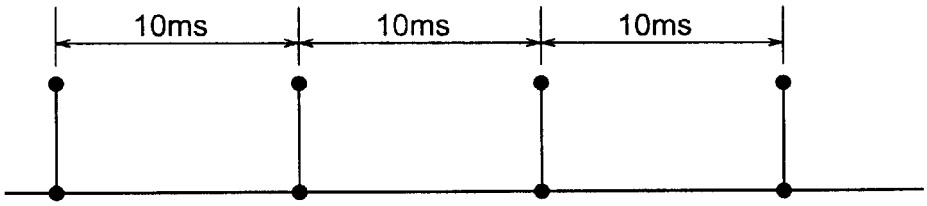
FIG. 7A is a view showing the timing of pulse application in the absence of offset.
Figure 7B:
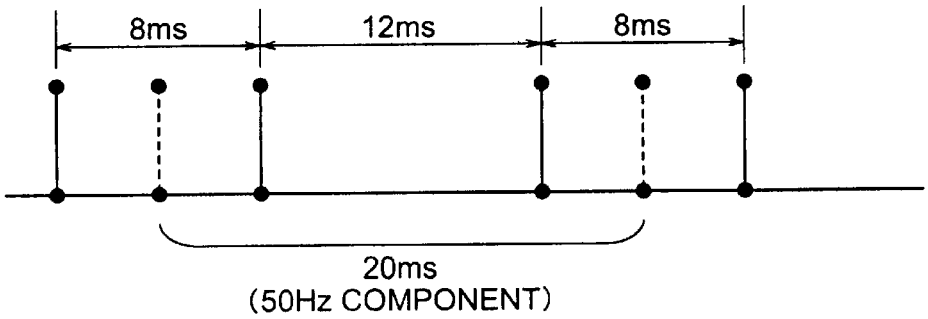
FIG. 7B is a view showing the timing of pulse application with ±2 msec offset being added.

However, addition of an offset, for example, ±2 msec to a time interval of 10 msec will make the time interval at which pulses are applied equal to 8 msec or 12 msec. FIG. 7A is a view showing the timing of pulse application in the absence of the offset, while FIG. 7B is a view showing the timing of pulse application with a ±2 msec offset being added.

As shown in FIG. 7A, in the absence of the offset added, human eyes will not recognize light emission frequencies other than 100 Hz. However, once the offset is added, as shown in FIG. 7B, the LED is recognized as if the LED is emitting light even at an intermediate timing (shown by a dotted line) during the short light emission interval of 8 msec. For this reason, one would feed as if-not only 100 Hz components but also 50 Hz components are generated in the spectrum of the light source or frequency components of light emission interval. Among the frequency components, human eyes recognize the 50 Hz frequency component as flicker, and it is therefore important to know the level of the flicker.

In the following explanations, for the sake of simplicity, suppose that the light source is driven by means of pulses with a width of zero.

In the absence of offset, the frequency components can be determined as follows. A pulse train (f(t)) with period T can be expanded by equation (1) shown below based on the Fourier expansion theorem for periodic functions.

$$f(t) = \sum_{n=0,\pm1,\pm2,\ldots} Fn \cdot \exp\left(2\pi ni \cdot \frac{t}{T}\right) \tag{1}$$

Thus, the frequency spectrum at frequencies other than $\omega_n = 2\pi n/T$ (n=0, ±1, ±2, . . . ) becomes zero.

For example, periodic pulses of 60 Hz provide the lowest frequency components of 60 Hz except direct current (DC) components. In particular, in the case of a single pulse provided at intervals of period T=1/60 sec, approximating the pulse width to be equal to zero, $$\text{Power (60 Hz)/Power (DC component)}=2.$$

Next, such a case is discussed in which the time interval of light emission of the light source is offset from 100 Hz.

In the presence of pulses at time, t=0, T/2+dt, T, 3T/2+dt, 2T, . . . , in a pulse train with a period of T=1/50 sec (that is, the periodicity of 100 Hz is slightly disturbed), the lowest frequency component (50 Hz component) other than a DC component can be expressed by equation (2) below in terms of the ratio of power (50 Hz) to the power (DC component).

$$\text{Power (50 Hz)/Power (DC component)}=2\sin^2(\pi \cdot dt/T) \tag{2}$$

This is because $$F(50\text{ Hz})=F\mathbf{1}=1+\exp\{-i(2\pi/T)(T/2+dt)\}=1-\exp(-2\pi i \cdot dt/T),$$

$$\text{Power (50 Hz)}=|F\mathbf{1}|^2+|F-1|^2=4\{1-\cos(2\pi dt/T)\}=8\sin^2(\pi dt/T),$$

and $$\text{Power (DC component)}=2^2=4.$$

Figure 8:
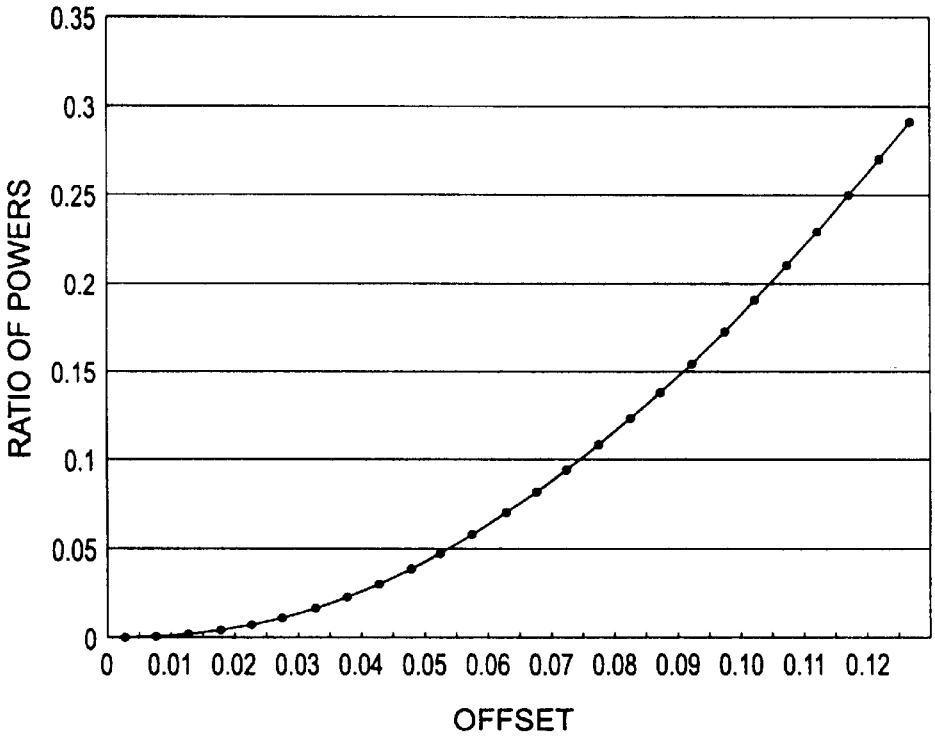
FIG. 8 is a plot showing the relation between the offset in the horizontal axis and the ratio of power in the vertical axis.

If 10% or less 50 Hz flicker is allowed, the power ratio is to be limited to 0.1 or less. Therefore, from equation (2), dt/T becomes 0.0718 or less. As mentioned above, with T=1/50 sec, dt becomes 44 msec or less. FIG. 8 is a plot showing the relation between the offset in the horizontal axis and the ratio of power in the vertical axis. In the figure, the ratio of power shows the power ratio of the 50 Hz component caused by the offset to the DC component.

It is also conceivable to limit the flicker level caused by the 50 Hz component to a flicker level corresponding to 60 Hz.

A video signal with a vertical synchronizing frequency of 60 Hz will cause human eyes to recognize flicker at the peripheral portion of the screen due to the property of the retina of the eyes. On the other hand, most people are said not to recognize flicker when viewing the central portion from the front of the eyes. Therefore, it is tremendously meaningful in practice to raise the level of occurrence of the large-area flicker substantially to the level of the video signal with the vertical synchronizing frequency of 60 Hz. The interval for limiting the flicker substantially to the level corresponding to that of 60 Hz can be determined by the calculation shown below.

Referring to the frequency sensitivity curve of the visual system suggested by Kelly, there is found a difference of 0.23 times in amplitude between the sensitivities of 50 Hz and 60 Hz. This means that light intensity needs to be modulated by 1/0.23 times the amplitude of 50 Hz to recognize the flicker of 60 Hz. Therefore, this provides a power difference in sensitivity of 0.0529 times (refer to Visual Perception, Academic Press, New York 1970, p. 389, by T. N. Cornsweet). Now, to obtain display with the same DC brightness between a periodic pulse of 60 Hz and a pulse of 50 Hz caused by slightly disturbed periodicity of 100 Hz, the interval dt between the gradation bit groups can be determined as follows.

The ratio of the power component of 50 Hz to that of 60 Hz is such that power (50 Hz)/power (60 Hz)=$\sin^2(\pi \cdot dt/T)$, where T=20 msec. Thus, letting that the value is equal to the ratio of sensitivity, 0.0529, in terms of power, it is obtained that dt=1.48 msec.

From the result of the above calculation, to obtain flicker limited to the level equal to or less than that corresponding to 60 Hz display, the time interval between the two gradation bit groups can be set 10 msec±1.48 msec. On the other hand, according to the idea that the component of 50 Hz (power) is to be limited to 0.1 or less of the DC component, the time interval between the two gradation bit groups may be set to 10 msec±1.44 msec. Accordingly, even when any one of the ideas is employed, the offset can be set to within 1.4 msec, thereby satisfying a practical limit at which the large-area flicker cannot be recognized as a signal interfering display images.

According to such way of thinking, consider the case where a signal to be recognized when offset is provided comprises a fundamental frequency component given to the vertical synchronizing signal of the video signal and a component of twice the frequency. In this case, it is understandably practical to limit the offset to approximately a quarter of one field period in order to limit the fundamental frequency component to 0.1 of the DC component. This idea will serve as a guideline when a video signal having a vertical synchronizing frequency higher than that recommended by the European TV standards is displayed such as in the case where a video signal from a computer is displayed.

Figure 9:
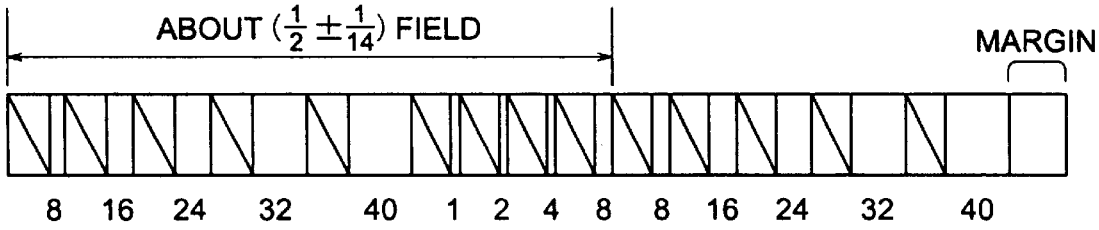
FIG. 9 is a schematic view showing an arrangement of sub-fields in a display method for a plasma display device according to a fifth embodiment of the present invention.

Next, a fifth embodiment of the present invention will be explained. In the fifth embodiment, redundant codes are used. FIG. 9 is a schematic view showing an arrangement of sub-fields in the display method for a plasma display device according to the fifth embodiment of the present invention.

The redundant codes have been frequently used. This technique provides highly effective measures against dynamic-image pseudo contours.

The prior-art display method employing redundant codes expresses the 256 levels of gradation by the combination of weights assigned to eight bits of 1, 2, 4, 8, 16, 32, 64, and 128.

In contrast, the present embodiment employs an sequence, 1, 2, 4, 8, 16, 32, 48, 64, and 80, with a common difference of 16 between the five higher order bits to express the same number of levels of gradation by the combination of weights assigned to nine bits.

Binary codes are employed for the lower order four sub-fields, which are therefore treated in the same way as the conventional method. Redundant codes act effectively on dynamic-image pseudo contours because a certain number of bits or more can be always ensured to light at the time of transition between levels of gradation by using the redundancy thereof. That is, this is because the center of gravity of light emission is not displaced a great deal.

In the fifth embodiment, each of the sub-fields corresponding to the gradation bits from the most significant bit B1 to the gradation bit B5, which is lower than the bit B1 by four bits, is divided into two halves. Then, a field constituted by nine sub-fields is rearranged, for example, into the following arrangement with 14 sub-fields, in which the sub-fields are arranged in ascending order as a whole or in a repeated manner of ascending order arrangements.

That is, in the first gradation bit group, let SF1=B5/2, SF2=B4/2, SF3=B3/2, SF4=B2/2, and SF5=B1/2. In the lower order sub-fields, SF6=B9, SF7=B8, SF8=B7, and SF9=B6. In the second gradation bit group, let SF10=B5/2, SF11=B4/2, SF12=B3/2, SF13=B2/2, and SF14=B1/2.

The sets of the sub-fields, which have been divided into halves, such as the sub-fields SF1 to SF5 and SF10 to SF14 are the aforementioned two gradation bit groups. Like the first and third embodiments, in the fifth embodiment, the first and the second gradation bit groups and the lower order non-divided sub-fields are arranged in ascending order as well. Weights W(x) can be assigned to the arrangements of these sub-fields, for example, as follows.

That is, they are set such that W(1)=8, W(2)=16, W(3)=24, W(4)=32, W(5)=40, W(6)=1, W(7)=2, W(8)=4, W(9)=8, W(10)=8, W(11)=16, W(12)=24, W(13)=32, and W(14)=40.

Figure 10:
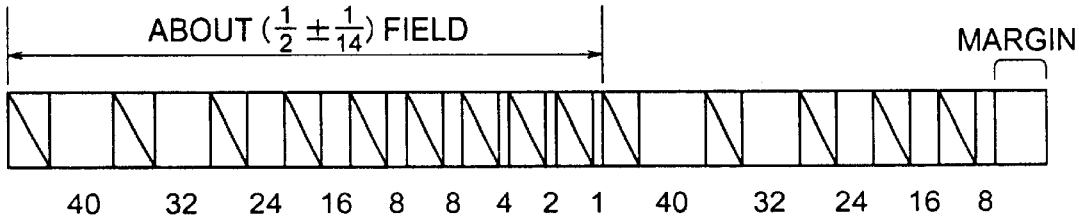
FIG. 10 is a schematic view showing an arrangement of sub-fields in a display method for a plasma display device according to a sixth embodiment of the present invention.

Even in the case of using redundant codes, the descending order arrangement can also be employed like the second and fourth embodiments. A sixth embodiment employs redundant codes in a descending order arrangement. FIG. 10 is a schematic view showing an arrangement of sub-fields in the display method for a plasma display device according to the sixth embodiment of the present invention.

With either an ascending order arrangement or a descending order arrangement, the large-area flicker and dynamic-image pseudo contours can be reduced to the same extent.

Figure 11:
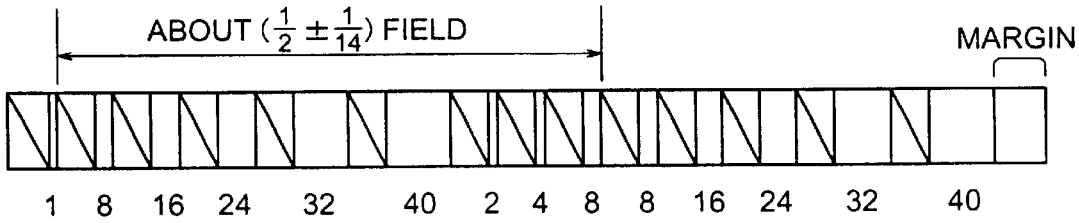
FIG. 11 is a schematic view showing an arrangement of sub-fields in a display method for a plasma display device according to a seventh embodiment of the present invention.

Next, a seventh embodiment of the present invention will be explained. FIG. 11 is a schematic view showing an arrangement of sub-fields in the display method for a plasma display device according to the seventh embodiment of the present invention.

In the seventh embodiment, the least significant sub-field (assigned with a weight of 1) among the lower order non-divided sub-fields is moved to the head of the field like in the third embodiment.

That is, in the first gradation bit group, let SF2=B5/2, SF3=B4/2, SF4=B3/2, SF5=B2/2, and SF6=B1/2. In the second gradation bit group, let SF10=B5/2, SF11=B4/2, SF12=B3/2, SF13=B2/2, and SF14=B1/2. In the lower order sub-fields, SF7=B8, SF8=B7, and SF9=B6 as well as SF1=B9.

Moreover, their weights W(x) can be assigned, for example, as follows.

That is, they are set such that W(1)=1, W(2)=8, W(3)=16, W(4)=24, W(5)=32, W(6)=40, W(7)=2, W(8)=4, W(9) =8, W(10)=8, W(11)=16, W(12)=24, W(13)=32, and W(14)=40.

According to the seventh embodiment, flicker can be prevented, for example, even when the interval between the two gradation bit groups exceeds a great deal one-half of a field in the fifth embodiment.

Incidentally, if the movement of the least significant bit does not provide sufficient adjustment, that is, the interval between the gradation bit groups does not fall within the range of (½±1/14) of a sub-field time, a bit that is higher by one may be moved to the head of the field while the ascending order arrangement is being sustained.

Figure 12:
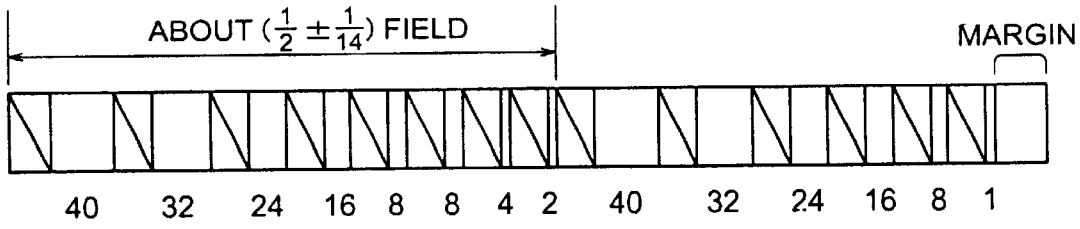
FIG. 12 is a schematic view showing an arrangement of sub-fields in a display method for a plasma display device according to an eighth embodiment of the present invention.

Next, an eighth embodiment of the present invention will be explained. FIG. 12 is a schematic view showing an arrangement of sub-fields in the display method for a plasma display device according to an eighth embodiment of the present invention.

In contrast to the seventh embodiment, the eighth embodiment employs a descending order arrangement and sets a sub-field corresponding to the least significant bit to the tail of one field.

In the redundant codes of the fifth to eighth embodiments, the total sum of the weights assigned to the five higher-order bits is 240. Therefore, this total sum coincides with that of the weights assigned to the four higher-order bits provided when ordinary binary codes are employed.

For this reason, in these embodiments, the number of higher-order bits to be divided is five, which determine the state of the large-area flicker occurring only at the time of display with high brightness. However, dividing only four bits provides almost no problem in practice since these bits provide a weight of 224. The same holds true for the case of binary codes. In this case, dividing only three higher-order bits would not present a significant problem.

Incidentally, in these embodiments, explained is a method for driving a surface discharge AC plasma display device with the scan period and the sustaining period being separated from each other. However, the display method of the present invention can also be applied to an AC or a DC plasma display device employing other drive method or having other configuration such as an orthogonal two-electrode configuration so long as the device employs the sub-field technique for gradation display.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A display method for a plasma display device using a plurality of sub-fields to display an image with gradation, comprising the steps of:

obtaining first and second gradation bit groups by dividing m ($4 \leqq m < n$) gradation bits from the most significant bit into two halves so as to make weights thereof half, where n is a total number of gradation bits;

arranging a plurality of sub-fields in said first and second gradation bit groups so as to be equal to each other; and determining a time interval between said first and second gradation bit groups to be h/2±h/14 (msec), where h (msec) is time of one field of a video signal to be displayed, by arranging at least one sub-field of the (n−m) non-divided gradation bits among said n gradation bits in between said first and second gradation bit groups.

2. The display method for a plasma display device according to claim 1, wherein said arranging at least one field comprising the steps of:

arranging higher order sub-fields by placing higher priority thereto among said (n−m) sub-fields in between said first and second gradation bit groups; and arranging the remaining sub-fields among said (n−m) sub-fields in a time interval other than one in between said first and second gradation bit groups.

3. The display method for a plasma display device according to claim 2, wherein sub-fields arranged within said first and second gradation bit groups, sub-fields arranged in between said first and second gradation bit groups, and sub-fields arranged in a time interval other than one in between said first and second gradation bit groups are arranged in ascending order in each group from a gradation bit with the least weight.

4. The display method for a plasma display device according to claim 2, wherein sub-fields arranged within said first and second gradation bit groups, sub-fields arranged in between said first and second gradation bit groups, and sub-fields arranged in a time interval other than one in between said first and second gradation bit groups are arranged in descending order in each group from a gradation bit with the greatest weight.

5. The display method for a plasma display device according to claim 3, wherein said arranging the remaining sub-fields comprising arranging the remaining sub-fields to a time interval present at a head of a field constituted by all sub-fields.

6. The display method for a plasma display device according to claim 4, wherein said arranging the remaining sub-fields comprising arranging said remaining sub-fields to a time interval present at a tail of a field constituted by all sub-fields.

7. The display method for a plasma display device according to claim 1, wherein a vertical synchronizing signal of said video signal has a frequency of 50 Hz, and an interval between said first and second gradation bit groups is in a range between 10−1.4 (msec) and 10−1.4 (msec).

8. The display method for a plasma display device according to claim 7, wherein said video signal has a gradation accuracy of 8 bits, said obtaining first and second gradation bit groups comprising dividing four gradation bits from the most significant bit into two halves, the number of sub-fields constituting one field is equal to 12, and where W(x) is a weight assigned to an x-th sub-field from the head sub-field, it holds that W(1)=16/2, W(2)=32/2, W(3)=64/2, W(4)=128/2, W(5)=1, W(6)=2, W(7)=4, W(8)=8, W(9)=16/2, W(10)=32/2, W(11)=64/2, and W(12)=128/2.

9. The display method for a plasma display device according to claim 1, wherein redundant codes are used as said gradation bits.

10. The display method for a plasma display device according to claim 9, wherein a vertical synchronizing signal of said video signal has a frequency of 50 Hz, said redundant codes are constituted by nine bits, from lower order bits in sequence, 1, 2, 4, 8, 16, 32, 48, 64, and 80, said obtaining first and second gradation bit groups comprising dividing five gradation bits from the most significant bit into two halves, the number of sub-fields constituting one field is equal to 14, and where W(x) is a weight assigned to an x-th sub-field from the head sub-field, it holds that W(1)=1, W(2)=16, W(3)=32/2, W(4)=48/2, W(5)=64/2, W(6)=80/2, W(7)=2, W(8)=4, W(9)=8, W(10)=16/2, W(11)=32/2, W(12)=48/2, W(13)=64/2, and W(14)=80/2.

* * * * *